US006883334B1

(12) United States Patent
Shah

(10) Patent No.: US 6,883,334 B1
(45) Date of Patent: Apr. 26, 2005

(54) COLD PLATE TEMPERATURE CONTROL METHOD AND APPARATUS

(76) Inventor: Preyas Sarabhai Shah, 591 10th Ave., Warminster, PA (US) 18974

( * ) Notice: Subject to any disclaimer, the term of this patent is extended or adjusted under 35 U.S.C. 154(b) by 0 days.

(21) Appl. No.: 10/702,566

(22) Filed: Nov. 5, 2003

(51) Int. Cl.[7] ..... F25D 21/04
(52) U.S. Cl. ..... 62/81; 62/196.4; 62/278; 62/156
(58) Field of Search ..... 62/196.4, 277, 62/278, 227, 203, 204, 205, 61, 151, 156

(56) References Cited

U.S. PATENT DOCUMENTS 2,770,104 A 11/1956 Sweynor
2,907,181 A * 10/1959 Nonomaque ..... 62/156
4,043,144 A * 8/1977 Klotz et al. ..... 62/277
4,615,183 A 10/1986 Juncos et al.
4,949,551 A 8/1990 Gregory
5,050,400 A 9/1991 Lammert
5,056,327 A 10/1991 Lammert
5,065,584 A 11/1991 Byczynski et al.
6,286,322 B1 9/2001 Vogel et al.

* cited by examiner

*Primary Examiner*—Harry B. Tanner
(74) *Attorney, Agent, or Firm*—RatnerPrestia

(57) ABSTRACT

A method and apparatus for controlling the temperature of a cold plate is disclosed. The temperature of the cold plate is controlled by directing compressed refrigerant along a first path configured to supply cooled refrigerant to the evaporator of the cold plate, redirecting at least a portion of the compressed refrigerant along a second path configured to supply non-cooled refrigerant to the evaporator of the cold plate, comparing a temperature reading associated with the cold plate to a predefined temperature range, and incrementally controlling the portion of the compressed refrigerant redirected along the second path responsive to the compared temperature reading. The temperature of the cold plate may be controlled to defrost the cold plate by redirecting substantially all of the compressed refrigerant along the second path for a predefined period of time responsive to a shutdown indicator.

20 Claims, 3 Drawing Sheets

COLD PLATE TEMPERATURE CONTROL METHOD AND APPARATUS

FIELD OF THE INVENTION

The present invention relates to the field of laboratory equipment and, more particularly, to methods and apparatus for controlling the temperature of a cold plate.

BACKGROUND OF THE INVENTION

Laboratories use cold plates to maintain specimen samples for dissection at desired cooled temperatures. A conventional cold plate utilizes a closed refrigeration circuit including an evaporator coil positioned within the cold plate, a compressor, and a condenser. The compressor compresses evaporated refrigerant drawn from the evaporator and passes the compressed refrigerant to the condenser, which removes heat from the compressed refrigerant. Compressed gaseous refrigerant, having a high temperature, is cooled in the condenser to become liquid. The cooled liquid refrigerant flows into the evaporator to cool the cold plate. At the same time, heat transfer from the air surrounding the cold plate evaporates the refrigerant within the evaporator, which is drawn back into the compressor.

There are two common techniques to control the temperature of the cold plate. These techniques include (1) turning the compressor on/off to control the flow of refrigerant to the cold plate and (2) turning an electric heater coupled to the cold plate on/off to warm the cold plate.

In systems that turn the compressor on/off to control temperature, the compressor cannot be turned on until the pressure on both side of the compressor equalizes. Turning on the compressor too soon requires a lot of power to overcome pressure differences, which may cause the compressor to overheat and/or malfunction. In addition, longer times between turning the compressor on and off may cause temperature overshoots and undershoots (e.g., +/−5° C.). In techniques using an electric heater, additional component are needed to heat the cold plate and additional energy is added to warm the cold plate, thereby increasing the cost and reducing the efficiency of these systems.

During use, water vapor in the air condenses on the cold plate. The condensed water on the cold plate becomes ice, which interferes with the use of the cold plate. Typically, the cold plate is periodically turned off, for example, at the end of each day, to allow the ice to melt. Often, laboratory procedures require disposal of liquid due to the defrost process prior to leaving the laboratory. Allowing the cold plate to defrost simply by turning it off may take fifteen minutes or more. Thus, the operator is inconvenienced by having to wait for the cold plate to defrost in order to dispose of the resultant water.

Accordingly, improved methods and apparatus are needed to control the temperature of a cold plate that are not subject to the above limitations. The present invention fulfills this need among others.

SUMMARY OF THE INVENTION

A method and apparatus for controlling the temperature of a cold plate is disclosed. The temperature of the cold plate is controlled by compressing a refrigerant received from an evaporator of a cold plate; directing the compressed refrigerant along a first path configured to receive compressed refrigerant from the compressor and to supply cooled refrigerant to the evaporator of the cold plate; redirecting at least a portion of the compressed refrigerant along a second path configured to receive compressed refrigerant from the compressor and to supply non-cooled refrigerant to the evaporator of the cold plate; comparing a temperature reading associated with the cold plate to a predefined temperature range; and incrementally controlling the portion of the compressed refrigerant redirected along the second path responsive to the compared temperature reading. The temperature of the cold plate may be controlled to defrost the cold plate by redirecting substantially all of the compressed refrigerant along the second path for a predefined period of time in response to an indicator.

BRIEF DESCRIPTION OF THE DRAWINGS

The invention is best understood from the following detailed description when read in connection with the accompanying drawings, with like elements having the same reference numerals. This emphasizes that according to common practice, the various features of the drawings are not drawn to scale. On the contrary, the dimensions of the various features are arbitrarily expanded or reduced for clarity. Included in the drawings are the following figures.

DETAILED DESCRIPTION OF THE INVENTION

Figure 1:
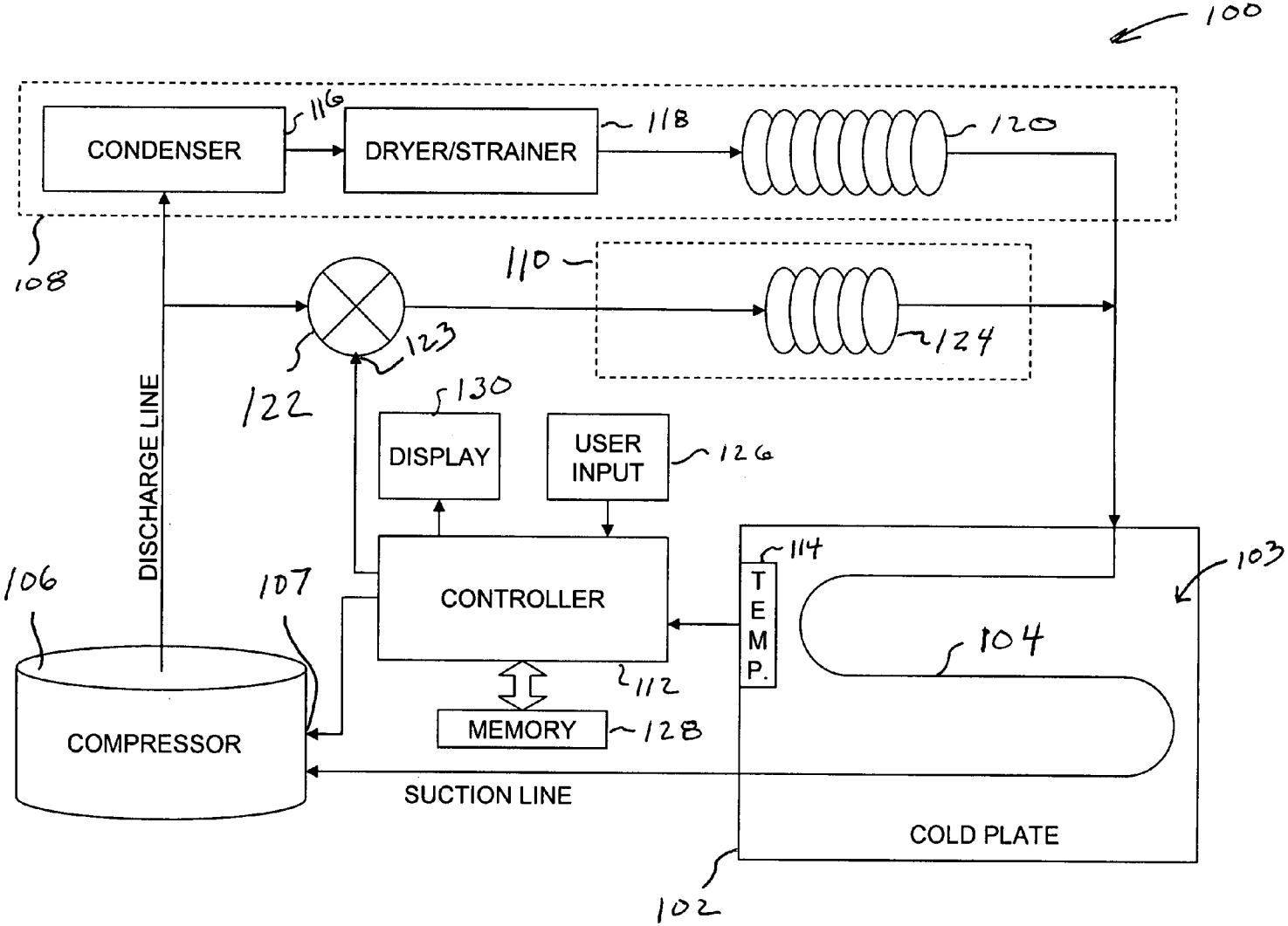
FIG. 1 is a block diagram of an exemplary cold plate temperature control apparatus in accordance with the present invention.

FIG. 1 depicts a cold plate 102 with an exemplary temperature control system 100 in accordance with the present invention. The cold plate 102 includes an evaporator 104. In general overview, a compressor 106 compresses refrigerant drawn from the evaporator 104 of the cold plate 102. The compressed refrigerant passes along a first path 108 configured to deliver cooled refrigerant to the cold plate 102 to cool the cold plate 102 and/or a second path 110 configured to deliver non-cooled refrigerant to the cold plate 102 to warm the cold plate 102. A controller 112 controls the portions of refrigerant passing along the first and second paths 108, 110 to reduce demands on the compressor 106, improve temperature control of the cold plate 104, and/or defrost the cold plate 104. The components of FIG. 1 will now be described in detail.

The cold plate 102 provides a surface 103 for receiving laboratory samples for cooling. In an exemplary embodiment, the cold plate 102 is made of an efficient heat conductor such as aluminum, copper, or stainless steel. An evaporator 104 of the cold plate receives refrigerant. The evaporator 104 may be embedded within the cold plate or attached to a top or bottom surface of the cold plate 102. In an exemplary embodiment, the evaporator 104 includes tightly packed hollow tubing passing through the interior regions of the cold plate 102 near the surface 103 of the cold plate 102. The hollow tubing is capable of circulating a refrigerant, such as Freon, having a temperature range between −40° C. or cooler and 100° C. or hotter. A conventional temperature (TEMP.) sensor 114 is embedded within the cold plate 102 to acquire the temperature of the cold plate 102 during use.

The compressor 106 compresses refrigerant for use in the temperature control system of the present invention. The compressor 106 is coupled to the evaporator coil 104 via a suction line to receive refrigerant used to control the temperature of the cold plate 102. The refrigerant from the evaporator coil is a gas, which is heated as it is compressed by the compressor 106. The compressed refrigerant, which is commonly referred to as "hot gas," exits the compressor 106 via a discharge line. The compressor 106 includes a control port 107 for use in turning the compressor on/off. A suitable compressor for use in the present invention will be understood by one of skill in the art from the description herein.

The first path 108 is configured to receive compressed refrigerant from the compressor 106 and deliver cooled refrigerant to the cold plate 102. The illustrated first path 108 includes a condenser 116, a dryer/strainer 118 and a capillary tube 120. The condenser 116 is coupled to the compressor 106 via the discharge line. The condenser 116 cools the compressed refrigerant and passes the cooled compressed refrigerant to the dryer/strainer 118. The dryer/strainer 118 removes moisture and impurities within the system. The compressed refrigerant then passes through a capillary tube 120 that acts as an expansion valve to the evaporator 104 where it is allowed to expand, thereby cooling the evaporator 104 which, in turn, cools the cold plate 104. Suitable condensers 116, dryer/strainers 118, and capillary tubes 120 for use with the present invention will be understood by those of skill in the art from the description herein.

The second path 110 is configured to receive compressed refrigerant from the compressor 106 and deliver non-cooled refrigerant to the cold plate 102. The non-cooled refrigerant from the compressor 106 is not passed through a condenser 116. The illustrated second path 110 includes a capillary tube 124, which acts as an expansion valve. Compressed refrigerant in the second path 110 passes, without cooling, through a capillary tube 124, which acts as an expansion valve, to the evaporator coil 104 where it heats the evaporator coil 104 which, in turn, heats the cold plate 102.

A controlled valve 122 controls the portion of compressed refrigerant passing along each of the first and second paths 108, 110. In the illustrated embodiment, the controlled valve 122 is coupled to the compressor 106 via the discharge line and is controlled by the controller 112. The controlled valve 122 is configured to redirect at least a portion of the compressed refrigerant in the discharge line from the first path 108 to the second path 110.

In an exemplary embodiment, the controlled valve 122 is a on/off valve such as an on/off solenoid valve. In accordance with this embodiment, the portion of refrigerant redirected along the second path 110 is controlled by controlling the duty cycle of the on/off valve. In an alternative embodiment, the controlled valve 122 is a proportional valve having a controllable aperture size such as a proportional solenoid valve. In accordance with this embodiment, the portion of the refrigerant redirected along the second path 110 is controlled by controlling the aperture size and/or the duty cycle of the proportional valve. Suitable valves for use with the present invention will be understood by those of skill in the art from the description-herein.

The controller 112 controls the compressor 106 and the controlled valve 122. The controller 112 is coupled to a control port 107 of the compressor 106 and a control port 123 of the controlled valve 122 within the second path 110. The controller 112 is configured to perform the controlling steps described with reference to FIGS. 2 and/or 3 below. The controller 112 may be a processor, microprocessor, microcontroller, state machine, logic gates, digital signal processor, analog circuitry, or essentially any device for processing digital and/or analog signals.

In addition, the controller 112 is coupled to the temperature sensor 114 of the cold plate for receiving temperature readings of the cold plate 102 and a user input 126 for receiving instructions from a user. The user input may be a switch and/or a control pad for entering commands and parameters to program the controller 112. User commands and parameters may be stored in a conventional memory 128. A conventional display 130 may be used to display information generated by the controller 112. The controller 112 and the display 130 may each be located in a housing (not shown) that houses the cold plate 102 or in a remote location external to the housing, e.g., in the housing of another device such as a "hot unit" (not shown). The controller 112 and the display 130 may be coupled to one another, the compressor 106, the controlled valve 122, and the temperature sensor 114 via a wired (e.g., a serial RS 232 data connection) or wireless connection. Suitable wireless or wire connections will be understood by those of skill in the art.

In an exemplary embodiment, the temperature control system 100 for the cold plate 102 can be configured in a program mode, a cooling mode, a shutdown mode, a standby mode, and off. When configured in the program mode, temperature parameters may be set using the user input 126 to program the controller 122. For example, the controller 122 may be programmed to set an internal time clock (not shown), turn on the compressor 106 from a standby mode at 8:00 am, lower the temperature to 10° C., and maintain the temperature at 20° C.+/−2.0° C.

In the cooling mode, the controller 112 controls the temperature of the cold plate 102 according to programmed parameters entered while in the program mode or in accordance with manual instructions received via the user input 126. The shutdown mode may be entered manually in response to a user instruction received via the user input 126 or automatically based on programmed instructions entered during the program mode. In the shutdown mode, the temperature control system 100 defrosts the cold plate for a predetermined period of time, which is described in detail below, and then enter a standby mode. In the standby mode, the temperature control system 100 waits for further instruction from the controller, such as an instruction to cool the cold plate 102 at a certain time. When off, the temperature control system 100 is completely shut down and can only be turned on manually.

Figure 2:
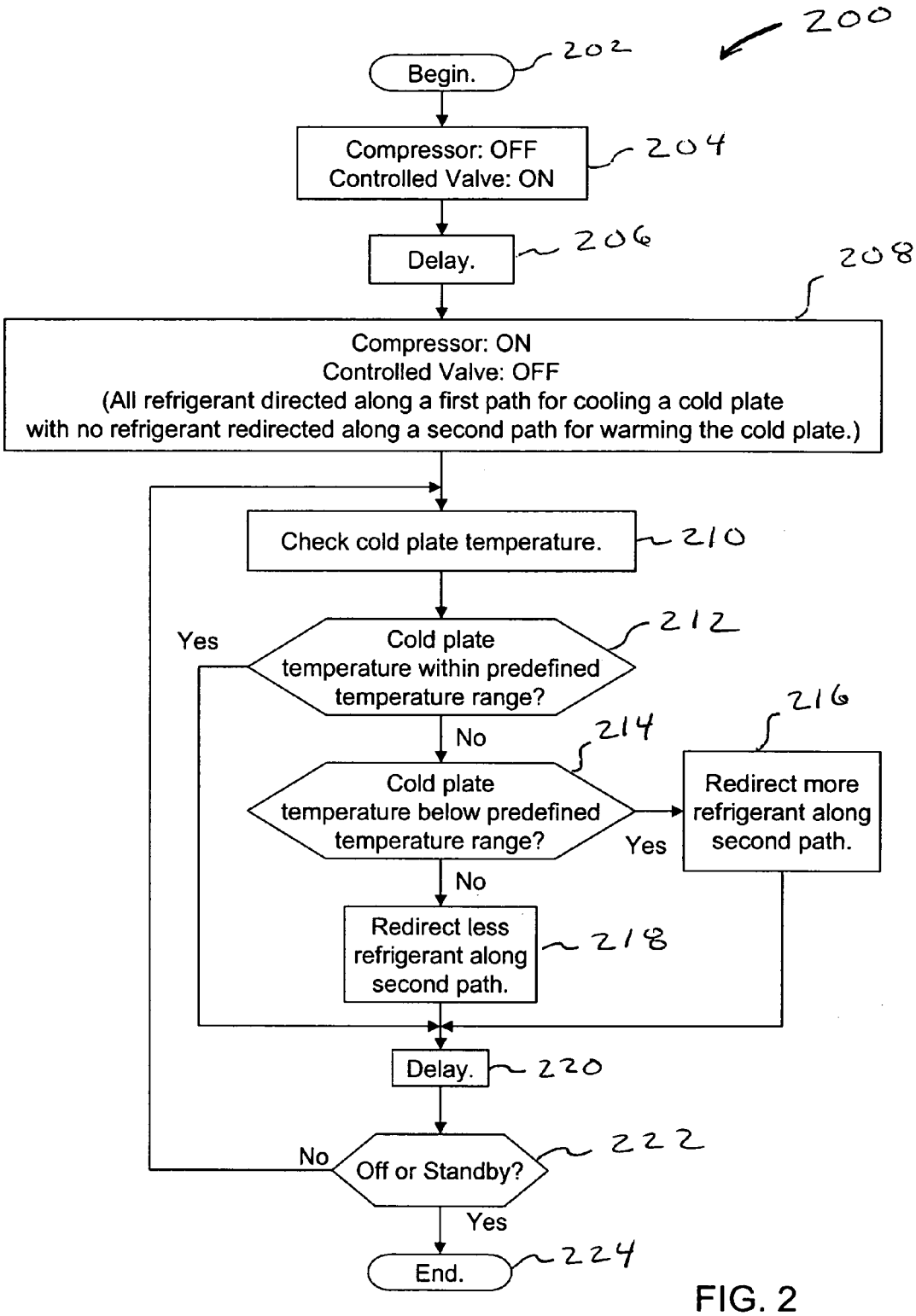
FIG. 2 is a flow chart of exemplary steps for controlling the temperature of a cold plate to regulate the temperature of the cold plate.

FIG. 2 depicts a flow chart 200 of exemplary steps for using the apparatus described with reference to FIG. 1 to power up the temperature control system and to control the temperature of the cold plate. Processing begins at block 202 with the compressor off and the controlled valve on (i.e., open) at block 204. At block 206, the controller maintains the existing state of the compressor and the controlled valve (i.e., compressor off and controlled valve on) for a predefined delay period, e.g., 120 seconds. Opening the controlled valve lowers the pressure on the discharge line of the compressor, thereby reducing the load on the compressor during start-up. Reducing the load on the compressor prevents stalling due to elevated pressure levels on the discharge line of the compressor 106. The elevated pressure levels may occur in the event of a power interruption while the compressor was running, for example.

At block 208, the controller turns the compressor on and turns off (i.e., closes) the controlled valve. With the controlled valve off, all refrigerant is directed along the first path for maximum cooling of the cold plate. In an alternative embodiment, the controlled valve may initially open partially to cool the cold plate at a slower than maximum cooling rate.

At block 210, the controller acquires the temperature of the cold plate by observing a temperature reading supplied by the temperature sensor within the cold plate.

At block 212, the controller determines if the temperature reading acquired at block 210 is within a predefined temperature range. In an exemplary embodiment, the predefined temperature range is entered via the user input for storage by the controller in the memory. In an alternative exemplary embodiment, a set temperature and a temperature tolerance value are entered and the controller determines the temperature range by subtracting and adding the temperature tolerance value to the set temperature. If the temperature reading is within the predefined temperature range, processing proceeds at block 220. Otherwise, processing proceeds at block 214.

At block 214, the controller determines if the temperature reading acquired at block 210 is below the predefined temperature range. If the temperature reading is below the predefined temperature range, processing proceeds at block 216. Otherwise, if the temperature reading is not below the predefined temperature range (indicating that the temperature reading is above the predefined temperature range), processing proceeds at block 220.

At block 216, the portion of refrigerant redirected along the second path is increased. The portion may be initially zero and then incrementally increased by increasing the duty cycle of the controlled valve and/or increasing an aperture size associated with the controlled valve. Increasing the portion of refrigerant directed along the second path increases the amount of non-cooled refrigerant ("hot gas") supplied to the evaporator of the cold plate (and decreases the amount of cooled refrigerant supplied to the evaporator by the first path), thereby warming the cold plate.

At block 218, the portion of refrigerant redirected along the second path is decreased. The portion may be incrementally decreased by increasing the duty cycle of the controlled valve and/or decreasing an aperture size associated with the controlled valve. Decreasing the portion of refrigerant directed along the second path decreases the amount of non-cooled refrigerant ("hot gas") supplied to the evaporator of the cold plate (and increases the amount of cooled refrigerant supplied to the evaporator by the first path), thereby cooling the cold plate.

At block 220, the redirected portion of refrigerant along the second path is maintained for a predefined delay period, e.g., 40 seconds. The delay period prevents erratic control of the controlled valve, which may result from too frequent control of the controlled valve based on temperature readings from the cold plate.

At block 222, the controller determines if the cold plate has entered a shutdown/standby mode or is turned off. If the cold plate is in a shutdown/standby mode or is turned off, processing ends at block 224. Otherwise, processing proceeds at block 210 with blocks 210 to 220 repeated until the cold plate is placed in a shutdown/standby mode or is turned off.

By opening the controlled valve prior to turning the compressor on, the system is able to reduce the presence of potentially damaging loads on the compressor. In addition, incrementally controlling the amount of refrigerant redirected along the second path (i.e., as "hot gas") to the evaporator of the cold plate enables the temperature of the cold plate to be controlled within a narrow range, e.g., within +/−2.0° C. or narrower, without the need for a separate heat source such as an electric heater.

Figure 3:
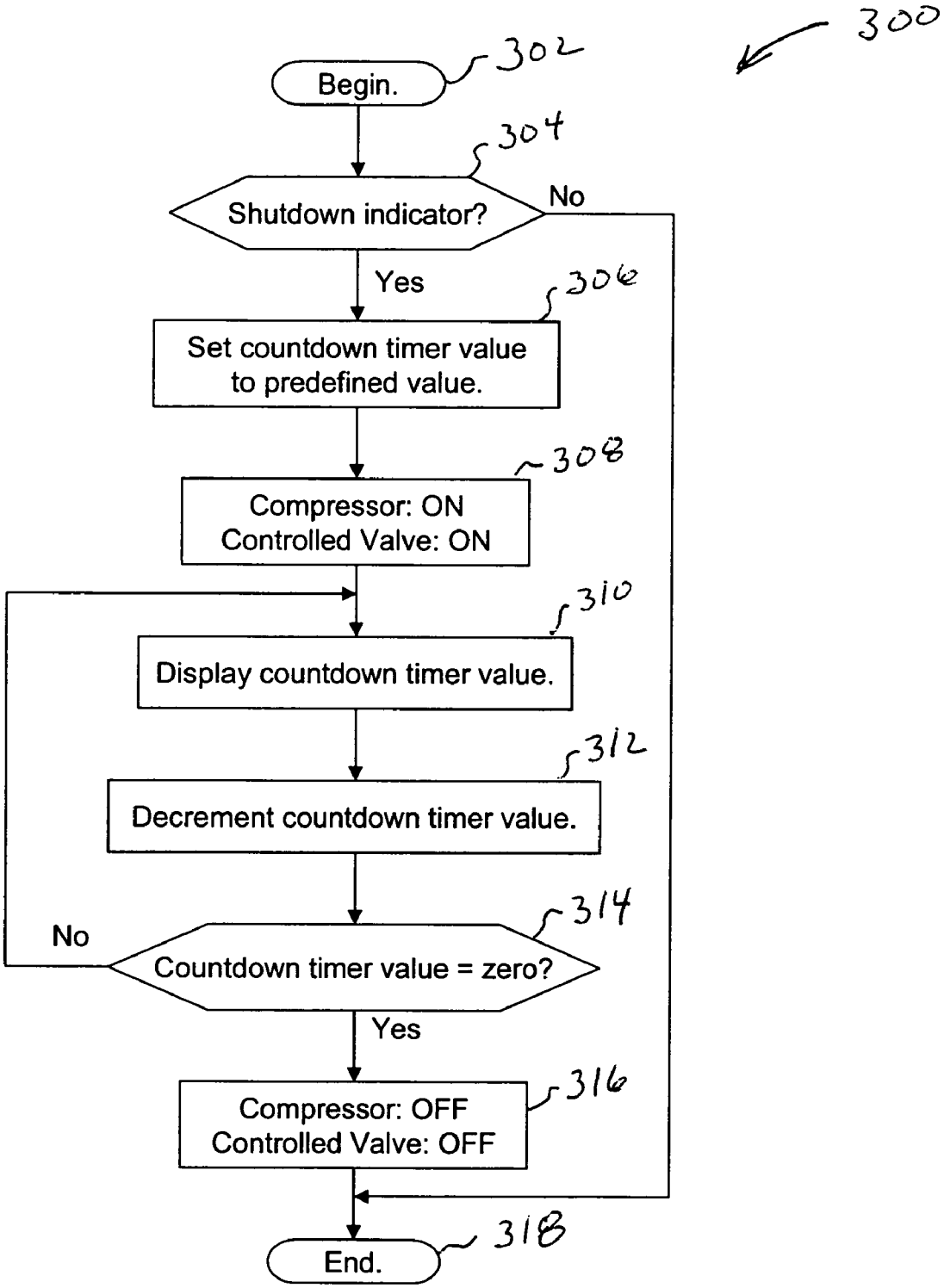
FIG. 3 is a flow chart of exemplary steps for controlling the temperature of a cold plate to defrost the cold plate.

FIG. 3 depicts a flow chart 300 of exemplary steps for using the apparatus described with reference to FIG. 1 to control the temperature of the cold plate to defrost the cold plate. Processing begins at block 302 with the receipt of a shutdown indicator at block 304. The shutdown indicator may be generated in response to a user instruction received via the user input or by the controller in response to instruction performed by the controller. The shutdown indicator may be an automatic or manual instruction to configure the temperature control system 100 in a standby mode.

At block 306, the controller sets a countdown timer value to a predefined value, e.g., 90 seconds. The predefined value may be a value stored in memory prior to delivery of the cold plate or may be entered by a user via the user input.

At block 308, the controller turns the compressor on (or leaves the compressor running if it is already on) and turns on (opens) the controlled valve to redirect at least a portion of the refrigerant along the second path to the cold plate, e.g., by at least partially opening an aperture associated with the controlled valve or controlling a duty cycle of the controlled valve. In an exemplary embodiment, the controlled valve is controlled to maximize the amount of refrigerant redirected along the second path, e.g., by fully opening the aperture associated with the controlled valve or adjusting the duty cycle of the controlled valve so that the controlled valve is continuously on (open).

At block 310, the current countdown timer value is displayed by the controller via the display. In an exemplary embodiment, additional text is supplied along with the countdown timer value, such as "Time remaining until shutdown:," to provide information to the user. For example, the additional text may provide an indication of why the compressor is running after placing the cold plate in shutdown mode.

At block 312, the controller decrements the countdown timer value and, at block 314, the controller determines if the countdown timer value is equal to zero. If the countdown timer value is equal to zero, processing proceeds to block 316. Otherwise, processing proceeds at block 310 with blocks 310 and 312 repeated until the countdown timer value is equal to zero.

At block 316, which is reached if the countdown timer value is zero, the controller turns off the compressor and turns off (closes) the controlled valve.

In an exemplary embodiment, e.g., at the end of a laboratory work shift, when an operator puts the temperature control system in a shutdown/standby mode, the compressor runs with the controlled valve fully on for 90 seconds. When on, the controlled valve redirects refrigerant passing between a compressor and an evaporator of a cold plate from a first path, which cools the refrigerant, to a second path, which leaves the refrigerant non-cooled (i.e., as "hot gas"). The non-cooled refrigerant entering the evaporator rapidly increases the temperature of the cold plate above freezing to melt frozen condensation on the cold plate (i.e., defrost the cold plate). Since the non-cooled refrigerant runs directly through the evaporator of the cold plate, the cold plate can be defrosted quickly, e.g., in less than two minutes, without the use of additional heat sources or reversing the flow of refrigerant. Thus, the operator is able to clean up liquids associated with the defrosting process in a matter of minutes rather than waiting fifteen minutes or more for the defrosting process to occur.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A method for controlling the temperature of a cold plate comprising the steps of:

compressing a refrigerant received from an evaporator of a cold plate;

directing the compressed refrigerant along a first path to the cold plate, the first path configured to receive compressed refrigerant from the compressor and to supply cooled refrigerant to the evaporator of the cold plate;

redirecting at least a portion of the compressed refrigerant along a second path to the cold plate, the second path configured to receive compressed refrigerant from the compressor and to supply non-cooled refrigerant to the evaporator of the cold plate;

comparing a temperature reading associated with the cold plate to a predefined temperature range; and controlling the portion of the compressed refrigerant redirected along the second path responsive to the compared temperature reading such that the redirected portion is incrementally increased if the temperature reading is below the temperature range to heat the cold plate and the redirected portion is incrementally decreased if the temperature reading is above the temperature range to cool the cold plate.

2. The method of claim 1, further comprising the steps of:

receiving a shutdown indicator; and redirecting substantially all of the compressed refrigerant along the second path for a predefined period of time responsive to the shutdown indicator to at least partially defrost the cold plate.

3. The method of claim 2, further comprising the step of:

displaying a remaining time indicator corresponding to the predefined period of time remaining for redirecting substantially all of the compressed refrigerant along the second path.

4. The method of claim 1, wherein a controlled valve redirects the compressed refrigerant and wherein the controlling step comprises the step of:

incrementally controlling a duty cycle of the controlled valve responsive to the temperature comparison to control the redirected portion of the compressed refrigerant.

5. The method of claim 1, wherein a controlled valve redirects the compressed refrigerant and wherein the controlling step comprises the step of:

incrementally controlling an aperture size of the controlled valve responsive to the temperature comparison to control the redirected portion of the compressed refrigerant.

6. A method for controlling the temperature of a cold plate to at least partially defrost the cold plate comprising the steps of:

compressing a refrigerant received from an evaporator of a cold plate;

directing the compressed refrigerant along a first path to the cold plate, the first path configured to receive compressed refrigerant from the compressor and to supply cooled refrigerant to the evaporator of the cold plate;

receiving a shutdown indicator; and redirecting at least a portion of the compressed refrigerant along a second path to the cold plate for a predefined period of time responsive to the shutdown indicator, the second path configured to receive compressed refrigerant from the compressor and to supply non-cooled refrigerant to the evaporator of the cold plate.

7. The method of claim 6, wherein the redirecting step comprises:

redirecting substantially all of the compressed refrigerant along the second path.

8. The method of claim 6, further comprising the step of:

displaying a remaining time indicator corresponding to the predefined period of time remaining for redirecting substantially all of the compressed refrigerant along the second path.

9. An apparatus for controlling the temperature of a cold plate comprising:

a cold plate including an evaporator having an input and an output;

a compressor having an output and an input coupled to the output of the evaporator for receiving refrigerant;

a first path coupled between the output of the compressor and the input of the evaporator, the first path configured to receive compressed refrigerant from the compressor and supply cooled refrigerant to the cold plate;

a second path coupled between the output of the compressor and the input of the evaporator, the second path configured to receive compressed refrigerant from the compressor and supply non-cooled refrigerant to the cold plate;

a controlled valve coupled to the output of the compressor to redirect at least a portion of the refrigerant from the first path to the second path;

a temperature sensor that obtains a temperature reading associated with the cold plate; and a controller coupled to the temperature sensor and the controlled valve, the controller configured to compare the temperature reading associated with the cold plate to a predefined temperature range and control the portion of the compressed refrigerant redirected along the second path responsive to the compared temperature reading such that the redirected portion is incrementally increased if the temperature reading is below the temperature range to warm the cold plate and the redirected portion is incrementally decreased if the temperature reading is above the temperature range to cool the cold plate.

10. The apparatus of claim 9, wherein the controller is further configured to receive a shutdown indicator and to redirect substantially all of the refrigerant along the second path for a predetermined period of time responsive to the shutdown indicator to at least partially defrost the cold plate.

11. The apparatus of claim 10, further comprising:

a display coupled to the controller, the display configured to display a remaining time indicator corresponding to the predefined time period remaining for redirecting substantially all of the refrigerant along the second path.

12. The apparatus of claim 11, wherein the display is located in a remote location.

13. The apparatus of claim 9, wherein the controlled valve is an on/off valve and wherein the controller incrementally controls a duty cycle of the on/off valve to control the redirected portion of the refrigerant.

14. The apparatus of claim 9, wherein the controlled valve is a proportional valve and wherein the controller incrementally controls an aperture size of the proportional valve to control the redirected portion of the refrigerant.

15. The apparatus of claim 9, wherein the controller is located in a remote location.

16. An apparatus for controlling the temperature of a cold plate to at least partially defrost the cold plate comprising:

a cold plate including an evaporator having an input and an output;

a compressor having an output and an input coupled to the output of the evaporator for receiving refrigerant;

a first path coupled between the output of the compressor and the input of the evaporator, the first path configured to receive compressed refrigerant from the compressor and supply cooled refrigerant to the cold plate;

a second path coupled between the output of the compressor and the input of the evaporator, the second path configured to receive compressed refrigerant from the compressor and supply non-cooled refrigerant to the cold plate;

a controlled valve coupled to the output of the compressor to redirect at least a portion of the refrigerant from the first path to the second path;

a switch configured to generate a shutdown indicator; and a controller coupled to the controlled valve, the controller configured to control the controlled valve responsive to receipt of the shutdown indicator such that at least a portion of compressed refrigerant is redirected along the second path for a predefined period of time.

17. The apparatus of claim 16, wherein the controller is configured to redirect substantially all of the refrigerant along the second path for the predetermined period of time responsive to the shutdown indicator.

18. The apparatus of claim 16, further comprising:

a display coupled to the controller, the display configured to display a remaining time indicator corresponding to the predefined time period remaining for redirecting substantially all of the refrigerant along the second path.

19. The apparatus of claim 18, wherein the display is located in a remote location.

20. The apparatus of claim 16, wherein the controller is located in a remote location.

* * * * *